US009962859B2

(12) United States Patent
Gaywala

(10) Patent No.: US 9,962,859 B2
(45) Date of Patent: May 8, 2018

(54) GEMSTONE PROCESSING

(71) Applicant: Sahajanand Technologies Private Limited, Saiyedpura (IN)

(72) Inventor: Rahul Mahendrakumar Gaywala, Nanavat (IN)

(73) Assignee: Sahajanand Technologies Private Limited, Saiyedpura (IN)

( * ) Notice: Subject to any disclaimer, the term of this patent is extended or adjusted under 35 U.S.C. 154(b) by 231 days.

(21) Appl. No.: 14/852,107

(22) Filed: Sep. 11, 2015

(65) Prior Publication Data

US 2015/0375421 A1 Dec. 31, 2015

Related U.S. Application Data

(63) Continuation-in-part of application No. 14/352,639, filed as application No. PCT/IN2012/000687 on Oct. 17, 2012.

(30) Foreign Application Priority Data

Oct. 17, 2011 (IN) ..... 2904/MUM/2011

(51) Int. Cl.
*B28D 5/00* (2006.01)

(52) U.S. Cl.
CPC ..... *B28D 5/0088* (2013.01)

(58) Field of Classification Search
CPC ..... B28D 5/00; B28D 5/008; B28D 5/0088; B23Q 16/02

(Continued)

(56) References Cited

U.S. PATENT DOCUMENTS 1,518,971 A * 12/1924 Edwards ..... B24B 5/025 29/DIG. 102
1,708,569 A * 4/1929 Fotheringham ..... B24B 5/025 451/247

(Continued)

FOREIGN PATENT DOCUMENTS

DE 8504419 5/1986
DE 10106189 11/2001

(Continued)

OTHER PUBLICATIONS

"U.S. Appl. No. 14/352,639, Non Final Office Action dated May 11, 2015", 7 pgs.

(Continued)

*Primary Examiner* — Robert Rose
(74) *Attorney, Agent, or Firm* — Schwegman Lundberg & Woessner, P.A.

(57) ABSTRACT

The present subject matter relates to an indexing unit for a gemstone processing machine. The indexing unit may include a base plate that may comprise a plurality of plates. Further, the base plate may be coupled to an indexing mechanism such that the indexing mechanism may impart rotational, translational, and tilting motion to the base plate. Further, the plurality of plates may include axially extending concentric holes in which a plurality of holders may be disposed. Further, the plurality of holes may hold the gemstone for processing. In one implementation, the plurality of holders may be coupled to one or more actuating mechanisms that may impart rotational, translational, and tilting motion to the individual holders.

10 Claims, 10 Drawing Sheets

(58) Field of Classification Search
USPC ..... 451/390, 384, 401, 403; 125/35, 30.01
See application file for complete search history.

(56) References Cited

U.S. PATENT DOCUMENTS

| | | | | | |
|---|---|---|---|---|---|
| 1,833,329 | A * | 11/1931 | Packer | ..... | B24B 5/025 29/33 J |
| 2,050,422 | A * | 8/1936 | Dalkowitz | ..... | B24B 5/025 451/221 |
| 2014/0246006 | A1 | 9/2014 | Gaywala | | |

FOREIGN PATENT DOCUMENTS

| | | |
|---|---|---|
| EP | 0945217 | 9/1999 |
| WO | WO-2009/113117 | 9/2009 |
| WO | WO-2013/093938 | 6/2013 |

OTHER PUBLICATIONS

"International Application No. PCT/IN2012/000687, International Preliminary Report on Patentability dated Feb. 13, 2014", (dated Feb. 13, 2014), 19 pgs.
"International Application No. PCT/IN2012/000687, International Search Report and Written Opinion dated Jun. 12, 2013", (dated Jun. 12, 2013), 10 pgs.
U.S. Appl. No. 14/352,639, filed Apr. 17, 2014, Gemstone Processing.

* cited by examiner

GEMSTONE PROCESSING

CLAIM OF PRIORITY

This application is a continuation-in-part of and claims the benefit of priority of U.S. patent application Ser. No. 14/352,639, filed on Apr. 17, 2014, which claims the benefit of priority to the U.S. national stage application filed under 35 U.S.C. 371 from International Application Serial No. PCT/IN2012/000687, which was filed Oct. 17, 2012, and published as WO 2013/093938 on Jun. 27, 2013, and which claims priority to India Application No. 2904/MUM/2011, filed Oct. 17, 2011, which applications and publication are incorporated by reference as if reproduced herein and made a part hereof in their entirety, and the benefit of priority of each of which is claimed herein.

TECHNICAL FIELD

The subject matter described herein, in general, relates to gemstone processing, and particularly but not exclusively, relates to an indexing unit of a gemstone processing machine.

BACKGROUND

Typically, a raw gemstone, i.e., a gemstone as found in its natural state has a highly irregular geometry and includes many contaminations. A series of steps are involved in processing the raw gemstone to obtain a finished gemstone. Major steps involved in the processing can include planning, cleaving or sawing, bruting, polishing, and final inspection. Usually, during the planning process, which is carried out before the actual processing of the gemstone is carried out, one or more three-dimensional profiles of the raw gemstone are obtained. Further, from among the various profiles, one shape for the finished gemstone to be cut from the raw gemstone is selected, for example, based on a customer preference. Once the shape of the gemstone is finalized, the gemstone is further put through the above mentioned operations.

In the field of gemstone processing, precise processing of the gemstone according to the selected shape is important, particularly, in case of precious gemstones, such as diamonds, where the monetary value of the gemstone depends on its size and clarity. To achieve precise processing of a diamond, predetermined marking are formed on the surface of the diamond prior to the cutting operations, and the actual processing of the gemstone is performed in accordance with the markings.

With recent advancement in technology, various automated machines, such as computer numerical controlled (CNC) machines, are employed for processing and finishing raw gemstone. In such machines the three-dimensional profile of the gemstone can be either obtained in the form of a predetermined profile, or the automated machine can create the profile(s). Once the profile is obtained, the machine can select one of the shapes of the finished gemstone or allow the user to decide a final shape for the gemstone. Once the profile is selected, the machine performs the different operations on the gemstone. Such machines are usually configured to process one gemstone at a time. Once the processing of one gemstone is completed, the gemstone is dismounted and another gemstone is mounted on the machine for processing.

SUMMARY

This summary is provided to introduce concepts related to an indexing unit of a gemstone processing machine and method for processing gemstones, and these concepts are further described below in the detailed description. This summary is not intended to identify essential features of the claimed subject matter nor is it intended for use in determining or limiting the scope of the claimed subject matter.

In an embodiment, the indexing unit of the gemstone processing machine includes a base plate having a plurality of axially extending holes. The base plate is mounted on a mounting shaft, and the mounting shaft is coupled to an indexing mechanism for actuating the base plate. Further, the indexing unit includes a plurality of holders. A holder is disposed in each of the plurality of axially extending holes of the base plate, and each holder is configured to hold a gemstone for processing on the gemstone processing machine.

BRIEF DESCRIPTION OF THE DRAWINGS

The detailed description is described with reference to the accompanying figures. The same numbers are used throughout the figures to reference like features and components. Some embodiments of the method(s) in accordance with the present subject matter are described, by way of example only, and with reference to the accompanying figures, in which.

DETAILED DESCRIPTION

Figure 1:
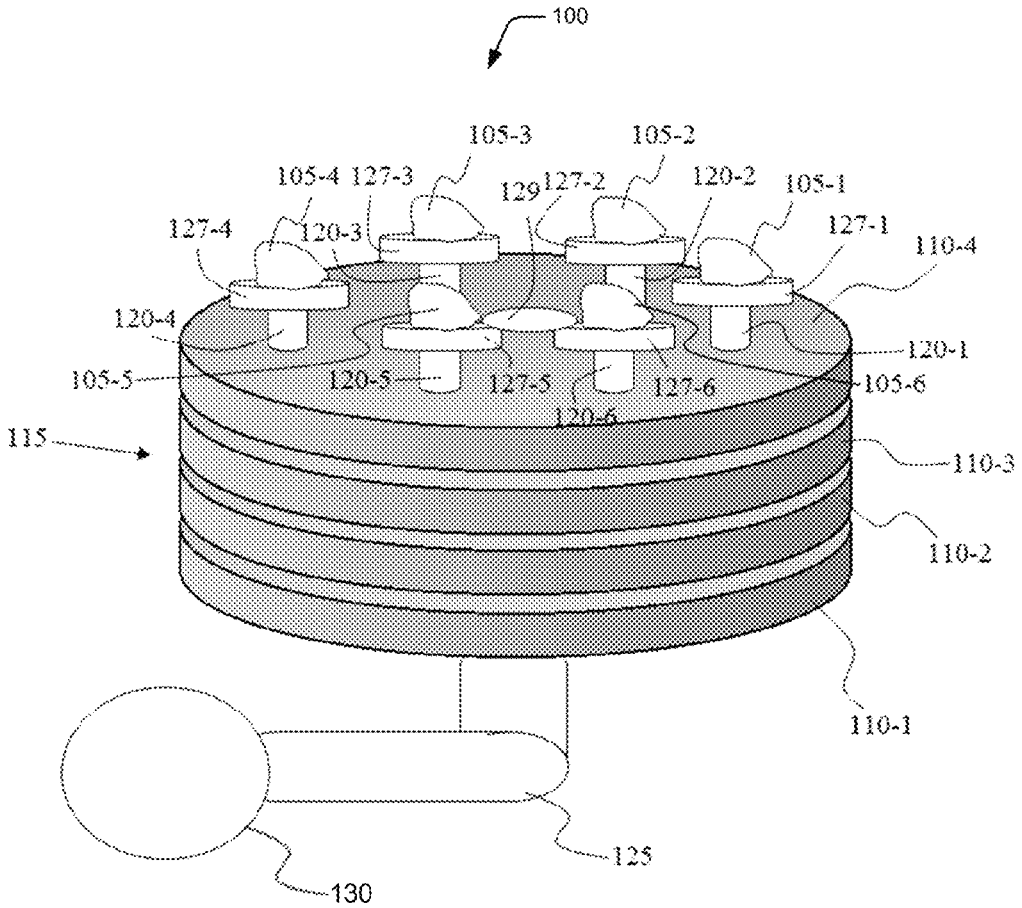
FIG. 1 illustrates a perspective view of an indexing unit for a gemstone processing machine, in accordance with an implementation of the present subject matter.

Conventionally, processing of gemstones is achieved on automated machines on which various steps are performed as part of gemstone processing. The steps can include, for example, sawing, bruting, and polishing. Such conventional machines are usually configured to process one gemstone at a time. Once the processing of one gemstone is completed, the gemstone is dismounted and another gemstone is mounted on the machine for processing. However, with such machines, the process of gemstone processing becomes time consuming and may delay the processing of the other gemstones in the pipeline, thereby leading to increase in the down time and decrease in the productivity. In case the productivity of processing gemstones is to be increased, a number of gemstone processing machines have to be installed, which can include various marking, sawing or bruting machines. However, in such a case, there can be a substantial increase in infrastructural and operational costs of processing gemstones, and can be uneconomical and unaffordable, particularly for small and medium scale enterprises.

The present subject matter describes an indexing unit for a gemstone processing machine, and a method for processing of gemstones. The indexing unit according to the present subject matter facilitates the mounting of a plurality of gemstones for processing on the gemstone processing machine. Accordingly, as soon as one gemstone is processed, another gemstone which is already mounted on the indexing unit is subsequently positioned for processing, while the gemstone already processed is moved away from the processing system and dismounted.

According to an embodiment of the present subject matter, the indexing unit of the gemstone processing machine includes a base plate mounted and fixed on a mounting shaft. In one implementation, the base plate can be formed as a single integrated piece, whereas in another implementation, the base plate can be formed of a plurality of plates stacked together. In the latter implementation, the various plates can be formed of different materials for cost effectiveness. For example, the plates at the extreme ends of the base plate can be formed of a strong and well machined material, while the plates stacked between these two plates can be formed of an inferior material. As a result, the cost of the gemstone processing machine is substantially reduced. Further, the plurality of plates may slide with respect to each other.

According to said embodiment, the base plate can be provided with a plurality of axially extending holes formed on an axial face of the base plate, such that the axially extending holes are substantially parallel to a central longitudinal axis of the base plate. Further, in each of the axially extending holes, a holder for holding a gemstone during gemstone processing can be disposed. The holder can be formed as a longitudinal member, say a shaft, which can be inserted into the axially extending hole of the base plate with a clearance fit, such that the holder is capable of motion while disposed in the axially extending hole.

Further according to an aspect of the present subject matter, the mounting shaft, on which the base plate is mounted, can be coupled to an indexing mechanism for actuating the base plate. The actuation of the base plate can be achieved either in a rotational motion or a translational motion or a combination thereof. The indexing mechanism can be configured to index the base plate to allow the already processed gemstone to move away from the processing unit, and the gemstone already mounted on a subsequent holder to be positioned for processing. In an example, the indexing mechanism can be one of a stepper motor, a direct current motor, and an alternating current motor.

In addition, the holders can be coupled to an actuating mechanism for providing actuation of the holders in the respective axially extending hole. The actuating mechanism can be configured to provide a rotational or a translational motion or a combination of the two motions, to the holders while disposed in the respective axially extending holes. In addition, the actuating mechanism may provide rotational, translational, and tilting motion to the individual holders. In one implementation, all the holders disposed in the axially extending holes can be coupled to a single actuating mechanism, whereas in another implementation, each holder can be provided with a separate actuating mechanism for individually controlling the motion of the holder. In one example, the actuating mechanism is one of a stepper motor, a direct current motor, and an alternating current motor.

Further, according to an aspect of the present subject matter, the holders can be coupled to the actuating mechanism through an operating member. The operating member can serve to transmit motion from the actuating mechanism to the holder, as well as provide torque or speed multiplication during the motion of the holders, as the need may be. In an example, the operating member can include one of a gear box, a chain drive, a belt drive, and a pinch roller system. As will be understood, in the same manner as described above, the operating member can be individually provided for the each holder in case the separate actuating mechanism is provided; otherwise, the indexing unit can include a single operating member.

According to an embodiment, a total of six axially extending holes are provided within the base plate to support six holders. Further, during operation of the gemstone processing machine, on each of the six holders, a different gemstone can be mounted for processing. After one gemstone is processed, the base plate can be rotated to index the other gemstones in the processing position. While the gemstone is being processed, the previously processed gemstone can be dismounted from the holder and substituted with another gemstone. Thus, the down time for processing of the multiple gemstones is substantially eliminated, thereby increasing the productivity of the gemstone processing machine.

In addition, for differently processing the gemstones, the same processing unit of the gemstone processing machine can be used, while differently marked gemstones can be actuated according to the required cutting and processing. As understood, the actuation can be performed by the actuation of the holder by the actuating mechanism, as well as by the actuation of the base plate by the indexing mechanism. Further, according to an aspect, the above described method for processing gemstones on a gemstone processing machine is also included herein as part of the present subject matter.

These and other advantages of the present subject matter would be described in a greater detail in conjunction with the following figures. It should be noted that the description and figures merely illustrate the principles of the present subject matter.

FIG. 1 illustrates a perspective view of an indexing unit 100 of a gemstone processing machine (not shown in FIG. 1). The indexing unit 100 according to the present subject matter facilitates the mounting of a plurality of gemstones 105-1, 105-2, 105-3, 105-4, 105-5, and 105-6, collectively referred to as gemstones 105 hereinafter, for processing on the gemstone processing machine. Accordingly, as soon as one gemstone 105 is processed, another gemstone 105 which is already mounted on the indexing unit is subsequently positioned for processing, while the gemstone 105 already processed is moved away from the processing system and dismounted. As a result, employment of the indexing unit 100 in the gemstone processing machines reduces down time required for mounting and demounting the gemstones 105 in the gemstone processing machine.

In an embodiment, the indexing unit 100 may serve as mechanism for mounting and rotating the plurality of gemstones 105 together in the gemstone processing machine. In one embodiment, the indexing unit 100 may be used, for example, in a laser planning machine, a laser sawing machine or a laser bruting machine for processing the plurality of gemstones.

As shown in FIG. 1, the indexing unit 100 includes a base plate 115. In an embodiment, the base plate 115 can be formed of a plurality of plates stacked together. In one example, a total of four circular plates 110-1, 110-2, 110-3, and 110-4 can be stacked together to form the base plate 115 of the indexing unit 100. For the purpose of this description, the plates 110-1, 110-2, 110-3, and 110-4 are collectively referred to as plates 110 hereinafter. Further, the plate 110-1 would be referred as first plate 110-1, the plate 110-2 would be referred as second plate 110-2, the plate 110-3 would be referred as third plate 110-3, and the plate 110-4 would be referred as fourth plate 110-4. Further, the plurality of plates 110 may slide with respect to each other. The mechanism for impart the sliding motion of the plurality of plates 110 would be explained in details in subsequent embodiments.

According to an implementation, the various plates 110 can be formed of different materials for cost effectiveness. For example, the plates 110-1 and 110-4 at the extreme ends of the base plate 115 can be formed of a strong and well machined material, while the plates 110-2 and 110-3 stacked between these two plates 110-1 and 110-4 can be formed of an inferior material. As a result, the cost of the gemstone processing machine is substantially reduced. In another implementation, however, the base plate 115 can be formed as a single integrated piece formed of a single material.

Further, in an embodiment, the base plate 115 is provided with a plurality of axially extending holes (not shown in FIG. 1) on an axial face, for accommodating holders 120-1, 120-2, 120-3, 120-4, 120-5, and 120-6, collectively referred to as holders 120. However, it will be understood that based on the mounting and configuration of the base plate 115 on the gemstone processing machine, the configuration and location of the axially extending holes can also be accordingly changed. For example, in case the base plate 115 is mounted with the axis being substantially horizontal to ground, and the gemstone processing machine is provided to process in a vertical direction with reference to the ground, then the holes can be provided on a radial face of the base plate 115.

In an implementation, each of the holders 120 may be formed of a longitudinal member, such as a shaft, and provided with a clamp for holding the gemstones 105. Accordingly, as can be seen from the figure, the holders 120 are provided with clamps 127-1, 127-2, 127-3, 127-4, 127-5, and 127-6 at their top end for holding the gemstones 105. However, in another case, the holders 120 can be provided with seats or other appropriate holding mechanism for holding the gemstone 105.

Figure 2:
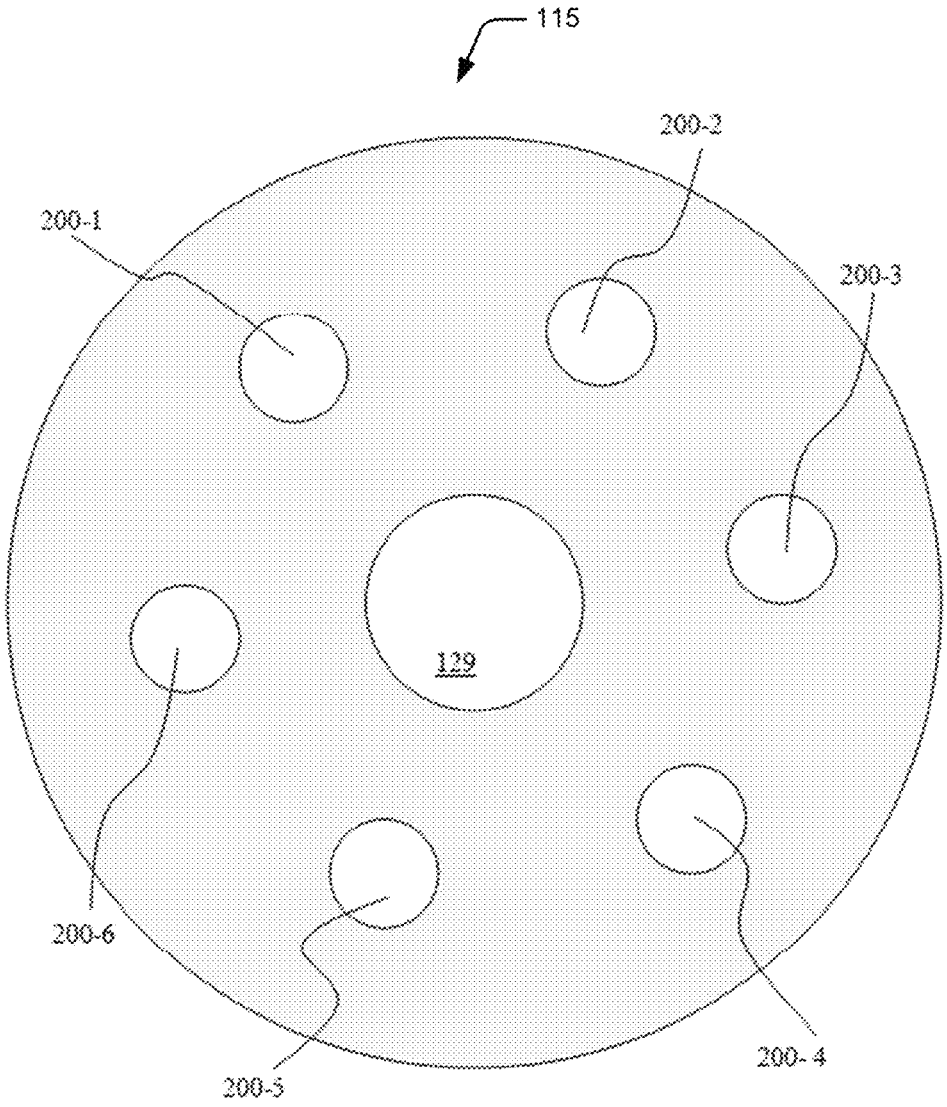
FIG. 2 illustrates a top view of a base plate of the indexing unit, in accordance with an implementation of the present subject matter.

FIG. 2 illustrates a top view of the base plate 115 of the indexing unit 100, in accordance with one embodiment of the present subject matter. As shown herein, the base plate 115 of the present subject matter has the central hole 129 for mounting on the mounting shaft 125. Additionally, the axially extending holes 200 on the axial surface of the base plate 115 are also seen. In an example, the base plate 115 can include six axially extending holes 200 to accommodate the six holders 120. As seen, in the present embodiment, the axially extending holes 200 are provided circumferentially equidistant from each other and also to be equidistant from the central longitudinal axis. However, in other embodiments, other configurations of the axially extending holes 200 can be achieved.

According to an embodiment, the base plate 115 is mounted on a mounting shaft 125 and is capable of motion while being mounted on the mounting shaft 125. For the purpose of allowing motion to the base plate 115, the base plate 115 can be fixedly mounted on the mounting shaft 125. In said implementation, the base plate 115 can be mounted on the mounting shaft 125 at a central hole 129, such that an interference or press fit is achieved between the base plate 115 and the mounting shaft 125. However, in another implementation, the base plate 115 can be mounted such that the connection between the base plate 115 and the mounting shaft 125 is formed as a clearance fit.

Further to provide motion to the base plate 115, the mounting shaft 125 can be coupled to an indexing mechanism 130. The mounting shaft 125 can be actuated by means of the indexing mechanism 130. The indexing mechanism 130 can, in turn, transfer the motion to the base plate 115. In an example, the indexing mechanism 130 of the present subject matter can be a stepper motor, an alternating current motor, or a direct current motor. The purpose of the indexing mechanism 130 is to index the gemstones 105 in the processing position for processing the gemstone 105. In another example, the indexing mechanism 130 can be provided with homing reference, say on the base plate 115, based on which the indexing mechanism 130 can achieve the indexing of the gemstones 105 in order to position the gemstones 105 for processing. In one example, the homing reference can be a proximity sensor installed on the base plate 115 that may sense the distance base plate 115 from the gemstone processing machine and accordingly, inform the operator to index the base plate 115. In another example, the homing reference can be an IR based system that may detect the position of the indexing unit 10000 with respect to the gemstone processing machine.

In an example, the base plate 115 can be configured to be capable of tilting, rotational motion about its axis, as well as translational motion. Such movement of the base plate 115 can save space in the gemstone processing machine allowing for packaging the components compactly. In addition, with such movements provided to the base plate 115 by the indexing mechanism 130, operator interference is minimized and throughput of the gemstone processing machine is high. The base plate 115, with the help of the indexing mechanism 130, can provide for indexing the gemstones with reference to a processing unit of the processing machine, during operation of the processing machine for processing the gemstones. After one gemstone 105 is processed, the base plate 115 can be indexed and rotated so that the other gemstones 105 are in the processing position. While another gemstone 105 is being processed, the previously processed gemstone 105 can be dismounted from the holder 120 and substituted with another gemstone 105. The mechanisms by which the indexing mechanism imparts various motions to the base plate 115 would now be explained in details with respect to FIG. 3*a*-3*c*.

Figure 3A:
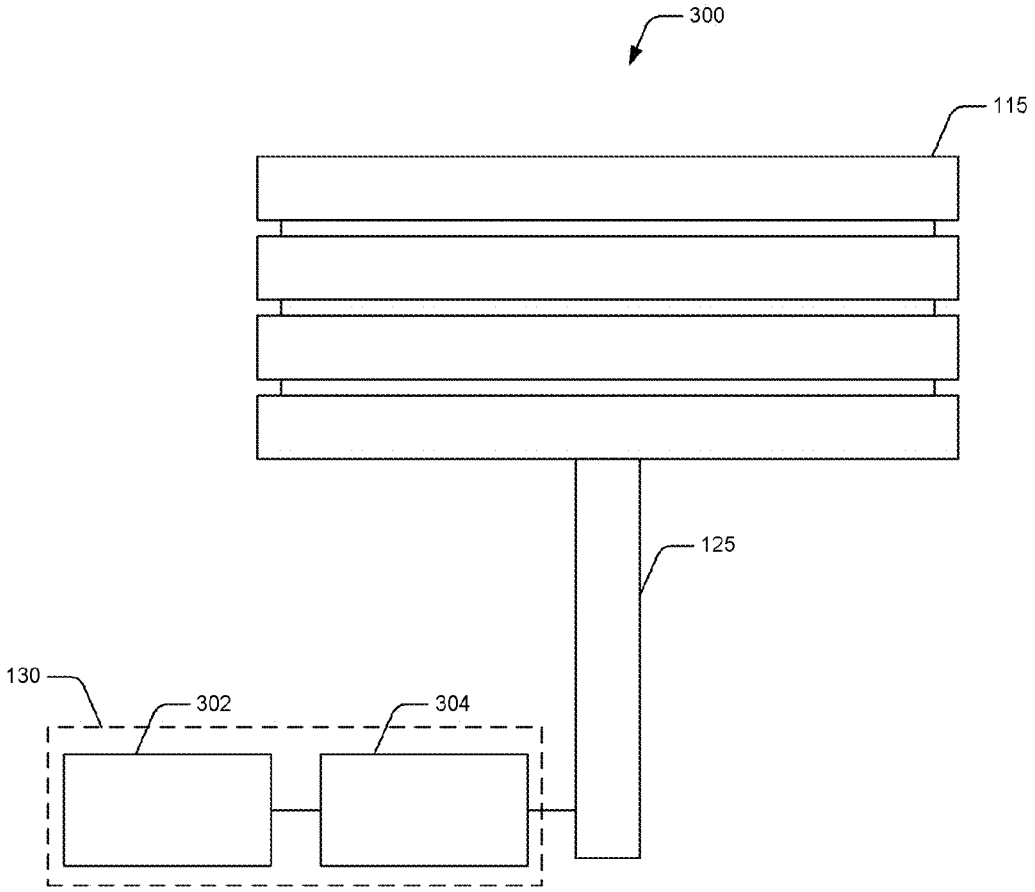
FIG. 3*a* illustrates a rotating mechanism of the indexing unit in accordance with one implementation of the present subject matter.

FIG. 3*a* illustrates a rotating mechanism of the indexing unit 100 in accordance with one implementation of the present subject matter. As mentioned previously, the indexing mechanism 130 may impart rotational motion to the base plate 115 through the mounting shaft 125. In the illustrated implementation, the indexing mechanism 130 may comprise a actuator 302 and a transmission system 304. Further, the actuator 302 may impart rotational motion to the transmission system 304 and the transmission system 304 may further transmit the motion to the mounting shaft 125. In one example, the actuator 302 may be, but not limited to, stepper motor, direct current motor or alternating current motor. Further, the actuation of the actuator 302 may controlled by a microcontroller or a programmable logic controller (PLC)

system or the like. In the illustrated implementation, the transmission system 304 can be, but not limited to, belt drive, chain driver, gear train, a continuously variable transmission (CVT) or the like.

In operation, the actuator 302 may actuate the transmission system 304 to impart rotational motion to the mounting shaft 125. For better understanding of the operation, the actuator 302 can be considered as a stepper motor and the transmission system 304 can be a belt drive system. In the exemplary implementation, the belt driver system can be an open belt drive system or a cross belt drive system. Further, a driver pulley of the transmission system 304 may be coupled to the stepper motor and a driven pulley of the transmission system 304 may be coupled to the mounting shaft. Further, a belt is looped around the driver pulley and the driven pulley under tension such that there is no slack in the belt. In order to rotate the mounting shaft 125, the actuator 302 may be rotated. Further, the rotation of the actuator 302 may be regulated by a microcontroller or PLC circuit. As the actuator 302 rotates, the actuator 302 drives the driver pulley. As the driver pulley rotates, the driver pulley moves the looped belt and the belt further drives the driven pulley. Since the driven pulley is coupled to the mounting shaft 125, the mounting shaft 125 also rotates along with the driven pulley. Therefore, the actuator 302 rotates the mounting shaft 125 to index the base plate 115.

In another implementation, the transmitting system 304 may be a chain drive in which a driver toothed wheel may be coupled to the actuator 302 and a driven toothed wheel may be coupled to the mounting shaft 125. In addition, a chain may be looped around the driver and the driven toothed wheels. In yet another implementation, the transmitting system 304 can be gear train in which a driver gear is in a mesh with a driven gear. Further, the driver gear may be coupled to the actuator and the driven gear may be coupled to the mounting shaft. In yet another implementation, the transmission system 304 can be the CVT system. In yet another implementation, the transmitting system 304 may be a fluid coupling that may be coupled to the actuator 302 and the mounting shaft 125 to impart rotational motion to the mounting shaft 125. In addition to the rotational motion, the base 115 may be configured to be capable of translational motion as well. An exemplary implementation of the translational motion would now be explained with respect to FIG. 3*b*.

Figure 3B:
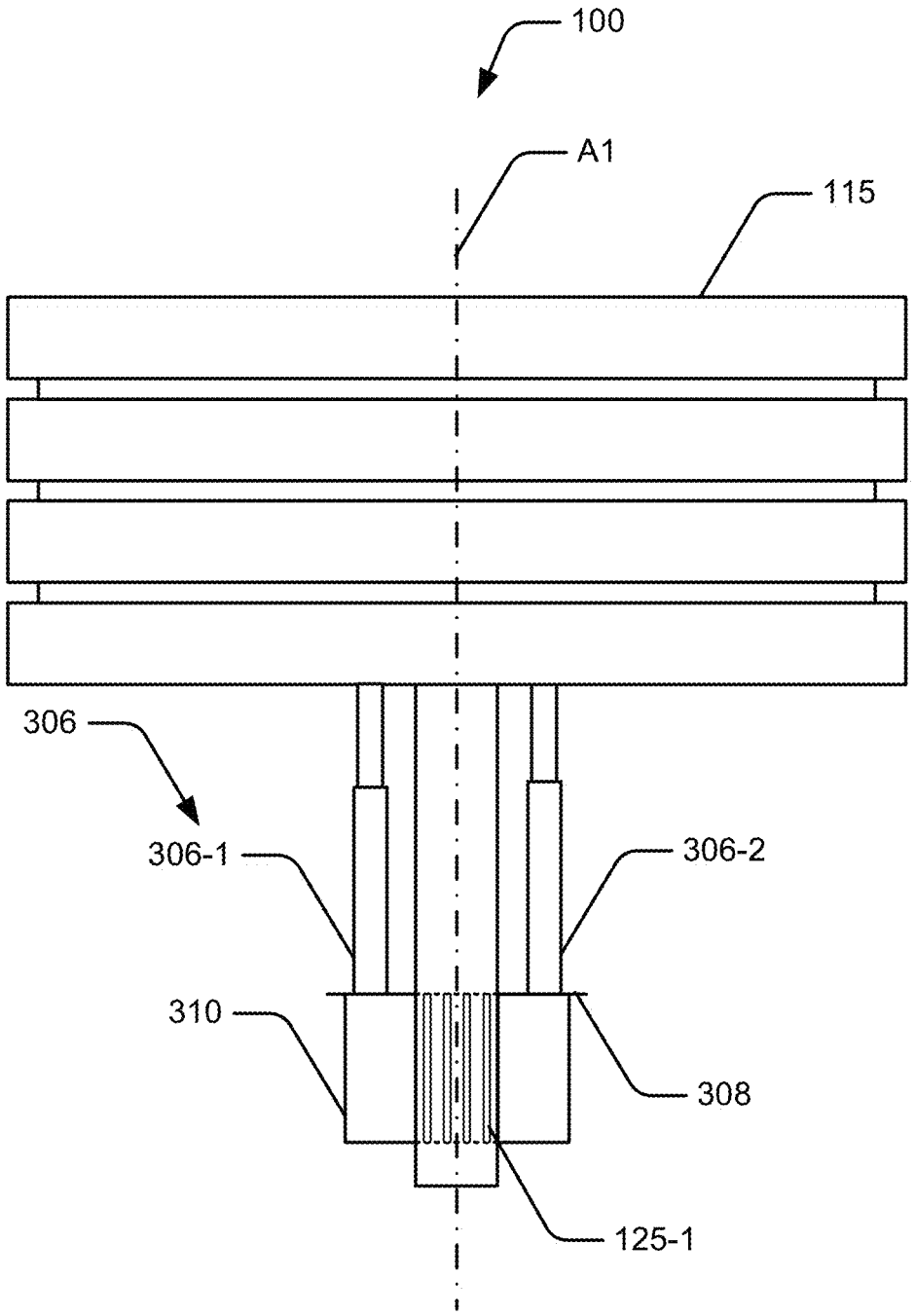
FIG. 3*b* illustrates a translational mechanism of the indexing unit in accordance with one implementation of the present subject matter.

FIG. 3*b* illustrates a translational mechanism of the indexing unit 100 in accordance with one implementation of the present subject matter. As mentioned previously, the base plate 115 may exhibit translational motion. In the illustrated implementation, the indexing mechanism 130 (shown in FIG. 3*a*) may include a plurality of linear actuator 306-1, 306-1; collectively referred as 306 hereinafter. Further, the linear actuator 306 may slide along a longitudinal axis A1 to translate the base plate 115 along the longitudinal axis A1. Further, the motion of the linear actuator 306 may be regulated by a micro controller or PLC circuit. In the illustrated implementation, one end of the linear actuator 306 may be coupled to the base plate 115 and the other end of the liner actuator 306 may be installed on a platform 308. The platform 308 may be understood as a base on which various actuators may be installed In the illustrated implementation, the mounting shaft 125 may be installed inside a hub 310 that may allow both rotational and translation motion of the mounting shaft. In one example, the mounting shaft 125 may be a spline shaft having male splines 125-1 on a radial surface of the mounting shaft 125. In addition, the hub 310 may contain female splines (not shown in FIG.) inside an inner radial surface of the hub 310 to receive male splines 125-1 such that the male spline can slide inside the female splines. Such an arrangement may facilitate in achieving the both the translational motion and rotational motion simultaneously. In one example, the hub 310 can be a driven pulley or a driven toothed wheel or a driven gear.

In operation, the base plate 115 needs to be raised to position the base plate 115 for gemstone processing machine (not shown in FIG.). In order to raise the base plate 115, the linear actuator 306 may be actuated by the micro controller. As a result, the linear actuator 306 may displace the base plate 115 along the longitudinal axis A1 in upward direction. As the base plate 115 moves upwards, the mounting shaft 125 also gets pushed. In this case, the male splines 125-1 of the mounting shaft 125 may slide inside the female splines allowing the mounting shaft 125 to slide upwards to process the gemstone 105 (FIG. 1). After the processing of the gemstone 105, the base plate 115 needs to be lowered down to dismount the processed gemstone. For the purpose, the liner actuator 306 may be actuated to displace the base plate 115 downwards. Similarly, when the linear actuator 306 pulls the base plate down, the male splines of the mounting shaft 125 slides inside the female splines to allow the mounting shaft 125 to slide downwards along the longitudinal axis A1. Thus, translational motion may be achieved by implementing the linear actuator 306.

In one implementation, the linear actuator 306 can be, but not limited to, pneumatic cylinder, hydraulic pistons, solenoid, or the like. Alternatively, the linear actuator 306 can be a rack and pinion mechanism. The aforementioned components can be used to impart translational motion to the base plate 115. In addition to the translational motion, the base plate 115 may be configured to be capable tilting motion as well. An exemplary implementation of the tilting motion would now be explained with respect to FIG. 3*c*.

Figure 3C:
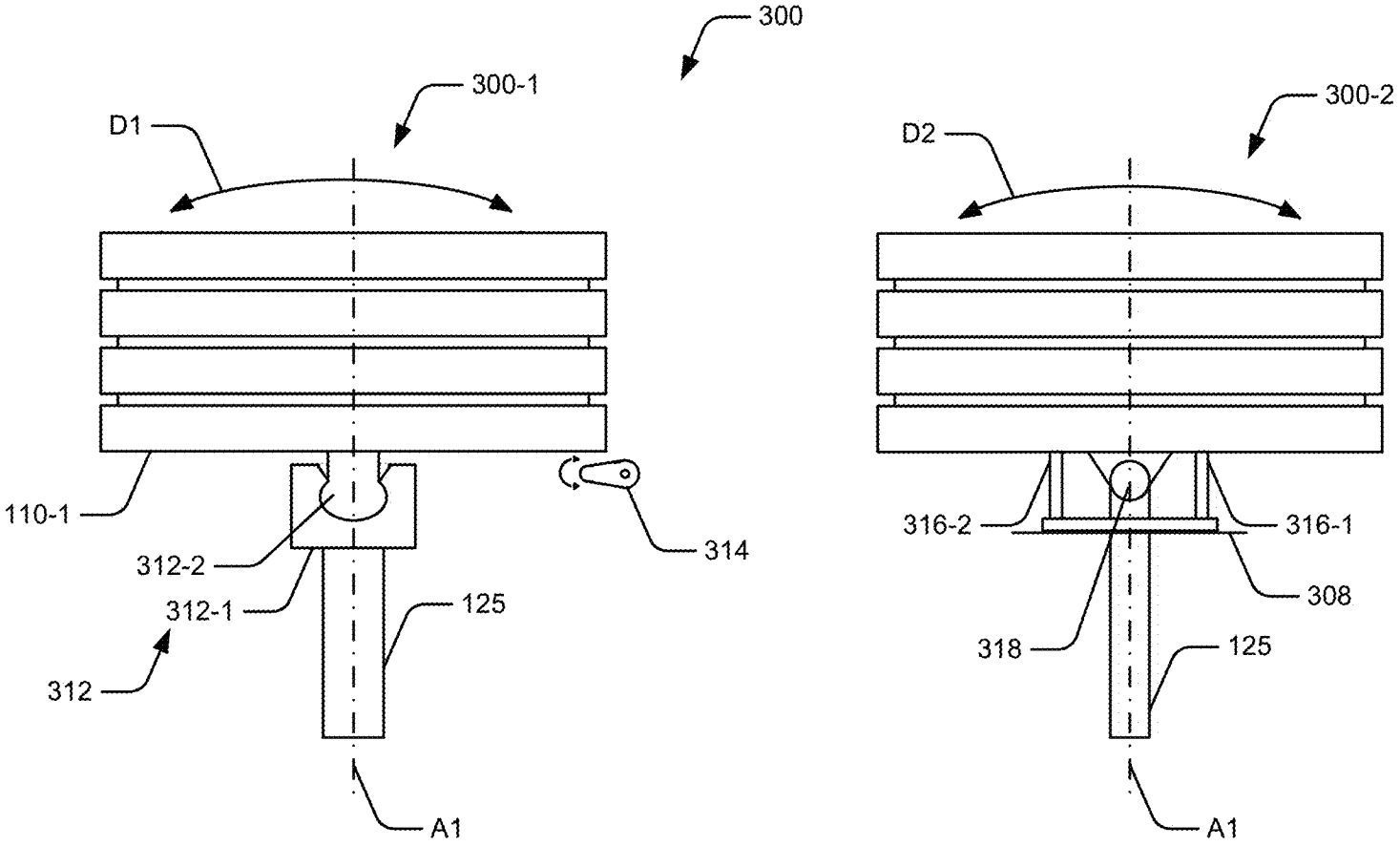
FIG. 3*c* illustrates tilting mechanisms of the indexing unit in accordance with one implementation of the present subject matter.

FIG. 3*c* illustrates tilting mechanisms 300 of the indexing unit 100 in accordance with one implementation of the present subject matter. The indexing unit 100 may include a tilting mechanism to impart tilting motion to the base plate 115. In the illustrated implementation, two different mechanisms 300-1, 300-2 are discussed. However, other mechanisms may be implemented without deviating from the scope of the present subject matter. In the first mechanism 300-1, a ball joint 312 may be installed on the mounting shaft 125. The ball joint 312 may include a housing 312-1 that may be coupled to the mounting shaft 125 and a pin 312-2 may be installed inside the housing 312-1 and may be coupled to the base plate 115. Further, one end of the pin 312-2 has a spherical profile such that the spherical portion may move inside the housing 312-1 and the pin 312-2 may be allowed tilt with respect to the longitudinal axis A1 up to a certain degree. In the illustrated implementation, the indexing mechanism 130 (shown in FIG. 3*b*) may include a cam 314 installed in proximity to the base plate 115. Alternatively, the cam 314 may be installed in proximity to a stem of the mounting shaft 125. Further, the cam 314 may rotate to make contact with the base plate 115 to tilt the base plate 115 in a direction D1. In the illustrated implementation, the base plate 115 may act as a follower for the cam 314. Further, the cam 314 may be rotated by an electric motor and the rotation can be regulated by the micro controller or PLC circuit.

The operation by which the base plate 115 may be tilted would now be explained. Initially, the base plate 115 is at upright position. In order to tilt the base plate, the cam 314 may be rotated. In the exemplary implementation, the cam 314 may be positioned below the first plate 110-4 and may be rotated in clockwise direction. As the cam 314 rotates, the cam 314 comes in contact with the lower region of the first plate 110-1. As the cam 314 further rotates, the cam 314 pushes the lower region of the first plate 110-1 to tilt with respect to the longitudinal axis A. Now, since the pin 312-2 is coupled to the base plate 115, the spherical portion of the pin 312-2 moves inside the housing 312-1 thereby facilitating the tilting of the base plate 115. In order to tilt the base plate 115 back to its original position, the cam 314 may be rotated in an anti-clockwise direction. As the cam rotates anti-clockwise, the cam 314 disengages from the lower region of the first plate 110-1 and the base plate 115 returns to its upright position. Therefore, the base plate 115 may be imparted tilting motion by the cam 314.

FIG. 3*c* also illustrates a second tilting mechanism 300-2 to tilt the base plate 115 in accordance with one implementation of the present subject matter. In the illustrated implementation, the base plate 115 may be hinged at a hinge point 318 so that the base plate 115 may tilt about the hinge point 318 in a direction D2. In one example, the hinge point 318 may be a knuckle joint, a double knuckle joint, a double cardan joint, a universal coupling, a constant velocity joint, a Thomson coupling or the like. Further, the hinge point 318 may be formed as an integrated part of the mounting shaft 125 or it can be installed as a replaceable assembly.

Further, the indexing mechanism 130 (shown in FIG. 3*a*) may include a plurality of solenoids 316-1, 316-1 that may be coupled to the lower region of the first plate 110-1. Further, the plurality of solenoids 316-1, 316-2 may be mounted on the platform 308. In one example, the indexing unit 100 may include multiple solenoids 316 that may provide three dimensional tilting motion to the base plate 115 with respect to the longitudinal axis A1. As mentioned previously, the operation of the solenoids 316-1 and 316-2 may be regulated by the micro controller or the PLC circuit.

In operation, one of the solenoids 316-1 or 316-2 may be operated to release tilt the base plate 115. Initially, the base plate 115 is at upright position. For example, the base plate 115 needs to be tilted towards left in the direction D2 to position the gemstone 105 for processing. In order to tilt the base plate 115, the solenoid 316-1 may be actuated. As the solenoid 316-1 actuates, the solenoid 316-1, pushes base plate 115 from one side. Since, the base plate 115 is hinged at the hinge point 318, the base plate 115 tilts towards the left of the longitudinal axis A1. Further, according to the illustrated implementation, the solenoid 316-2 may simultaneously be lowered to facilitate the tilting of the base plate 115. Therefore, the base plate 115 may tilt to the left of the longitudinal axis A1. Now, in order to bring the base plate 115 or to tilt the base plate towards right of the axis A1, the solenoid 316-1 may be lowered and simultaneously, the solenoid 316-2 may be raised. As understood, the tilting motion can also be provided in various directions with the help of more solenoids 316.

As mentioned previously, the indexing mechanism 130 based on the present subject matter is capable of imparting of the rotational motion, the translational motion, and the tilting motion to the base plate 115 simultaneously. The hub 310 may receive the drive from the actuator 302 to rotate the mounting shaft 125. Simultaneously, the linear actuator 306 may translate the base plate 115 along the longitudinal axis A1. Since, the hub 310 and the mounting shaft 125 include splines, the mounting shaft 125 may translate along the longitudinal axis A1 and simultaneously may rotate about the longitudinal axis A1. As for the tilting motion, the cam 314 may tilt the base plate 115 when the mounting shaft 125 is rotating. In one example, the linear actuator 306 may be coupled to the housing 312-1 such that the base plate 115 and the ball joint 312 may translated together. Now, when the base plate 115 is translated, the base plate 115 remains substantially upright and the translation motion does not affect the tilting motion.

According to an aspect of the present subject matter, the plurality of holders 120 may also exhibit rotational, translational, and tilting motion. The exemplary implementation of the plurality of holders 120 would now be explained in the subsequent embodiments.

Figure 4:
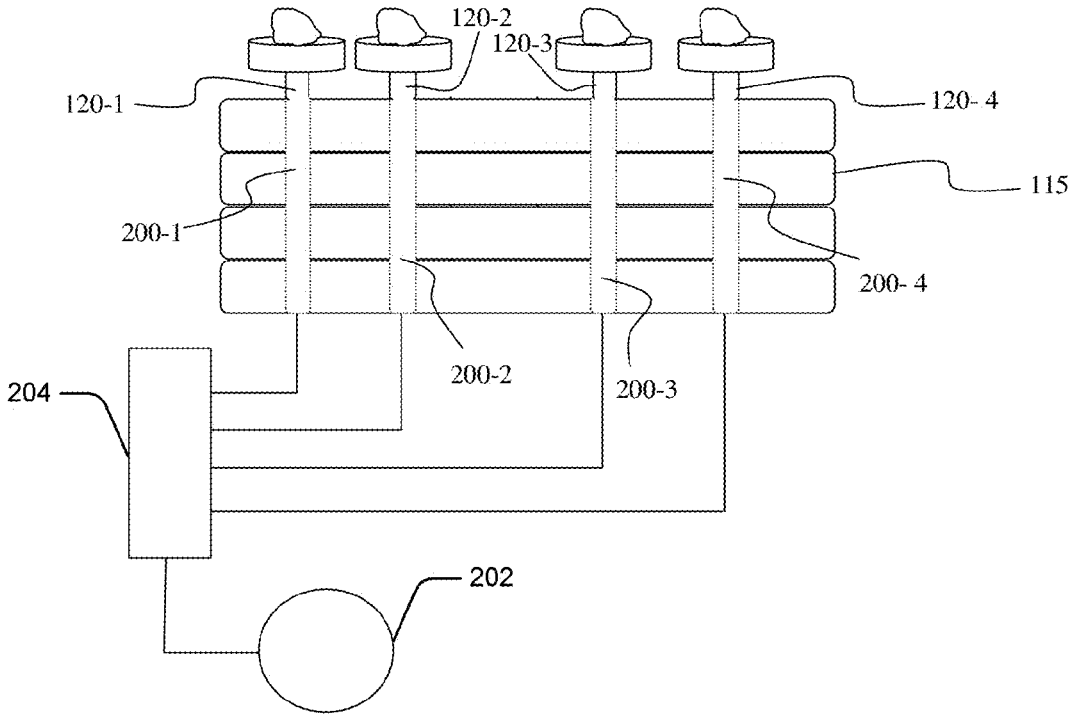
FIG. 4 illustrates a cross-sectional schematic representation of the indexing unit, in accordance with an implementation of the present subject matter.

FIG. 4 illustrates a cross-sectional schematic representation of the indexing unit 100, in accordance with one embodiment of the present subject matter. As mentioned previously, the base plate 115 includes a plurality of axially extending holes 200-1, 200-2, 200-3, and 200-4, collectively referred to as the axially extending holes 200, for accommodating the holders 120. In an example, the axially extending holes 200 can be blind holes, whereas in another example, the axially extending holes 200 can be through-holes.

In one embodiment, the holders 120 are disposed in the axially extending holes 200 in such a way that the holders 120 are capable of the rotational and translational motion inside the axially extending holes 200. In an example, to allow the motion of the holders 120 inside the axially extending holes 200, the holders 120 can be supported within the axially extending holes 200 with the help of bearings, say roller bearings (not shown in FIG. 4).

Further, according to an embodiment, the holders 120 can be coupled to an actuating mechanism 202. The actuating mechanism 202 can be configured to provide the rotational, translational, and combined motion to the holders 120. In one implementation, all the holders 120 disposed in the axially extending holes 200 can be coupled to a single actuating mechanism 202. In another implementation, each holder 120 can be provided with a separate actuating mechanism 202 for individually controlling the motion of the holder. In one example, the actuating mechanism 202 can be a stepper motor, a direct current motor, or an alternating current motor.

Further, according to said embodiment, the actuating mechanism 202 is coupled to the holders 120 through an operating member 204. The operating member 204 can serve to transmit motion from the actuating mechanism 202 to the holders 120, as well as provide torque or speed multiplication during the motion of the holders 120, as the need may be. In an example, the operating member 204 can include one of a gear box, a chain drive, a belt drive, and a pinch roller system. As will be understood, in the same manner as described above, the operating member 204 can be individually provided for each holder 120 in case a separate actuating mechanism 202 is provided. In another case, a single operating member 204 can be provided in the indexing unit 100.

The actuating mechanism 202 and the operating member 204 thus allow for the motion of the holders 120 during the operation of the gemstone processing machine for processing the gemstones. The holders 120 can be provided with various types of motions, say tilting, rotational, and translational motion, for cutting and processing the gemstone in the required shape. Such multi-axial motion capabilities provided independently to each of the holders 120 allows accurate alignment of the gemstone 105 with a cutting plane providing for high accuracy in gemstone cutting and shaping. The mechanisms by which the actuating mechanism 202 may impart rotational motion, translational motion, and tilting motion to the holder 120 would now be discussed in detail with respect to FIG. 5*a*-5*d*.

Figure 5A:
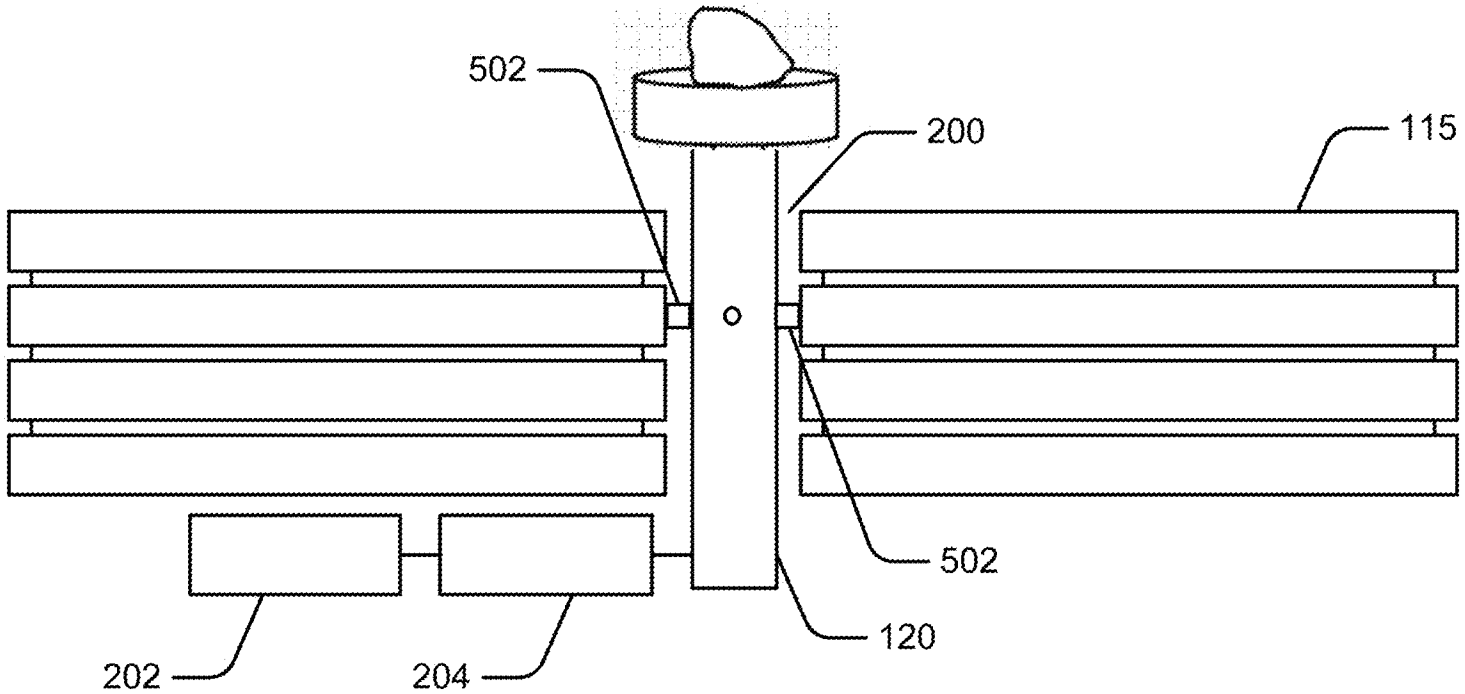
FIG. 5*a* illustrates a side view of the base plate depicting a rotational motion of the holder in accordance with one implementation of the present subject matter.

FIG. 5*a* illustrates a side view of base plate depicting the holder 120 being installed inside the hole 200 in accordance with one implementation of the present subject matter. In the illustrated implementation, the bore of the hole 200 may be larger than the diameter of the holder 120 so as to facilitate the rotational motion of the holder 120. Further, the holder 120 may be supported in the hole 200 by bearings 502. The bearings 502, in operation, may allow the holder 120 to rotate inside the hole 200. Further, a bottom end of the holder 120 may be coupled to the operating member 204 that may further be coupled to the actuating mechanism 202. In one implementation, the operating member 204 and the actuating mechanism 202 may be integrated to the base plate 115. Further, the actuating mechanism 202 can be a stepper motor, direct current motor, alternating current motor, or the like. Like the actuator 302, the operation of the actuating mechanism 202 may be regulated by a micro controller or a PLC circuit. In an implementation, the micro controller employed to regulate the operation of the indexing mechanism 130 may also be used to regulate the operation of the actuating mechanism 202. Alternatively, a dedicated micro controller may be installed to regulate the operation of the actuating mechanism 202.

Further, in the illustrated implementation, the operating member 204 can be, but not limited to, the belt drive, chain drive, pinch roller system, or the like. In case the operating member 204 is the belt drive or the chain drive system, a driver pulley of the belt drive may be coupled to the actuating mechanism 202 and a driven pulley of the belt drive may be coupled to the holder 120. In addition, a belt may be looped around the driver pulley and the driven pulley. Further, the belt may transmit the power from the driver pulley and the driven pulley. In the illustrated implementation, individual holders 120 may be provided with individual actuating mechanism 202. Alternatively, the holders 120 may be provided with a single actuating mechanism 202 and the holder 120 may be coupled to individual operating members 204 that may receive the drive from the actuating mechanism 202. For example, the belt of the belt drive system may be looped around the driven pulley of the individual holders 120 and may get the drive from the driven pulley coupled to the actuating mechanism 202.

Figure 5B:
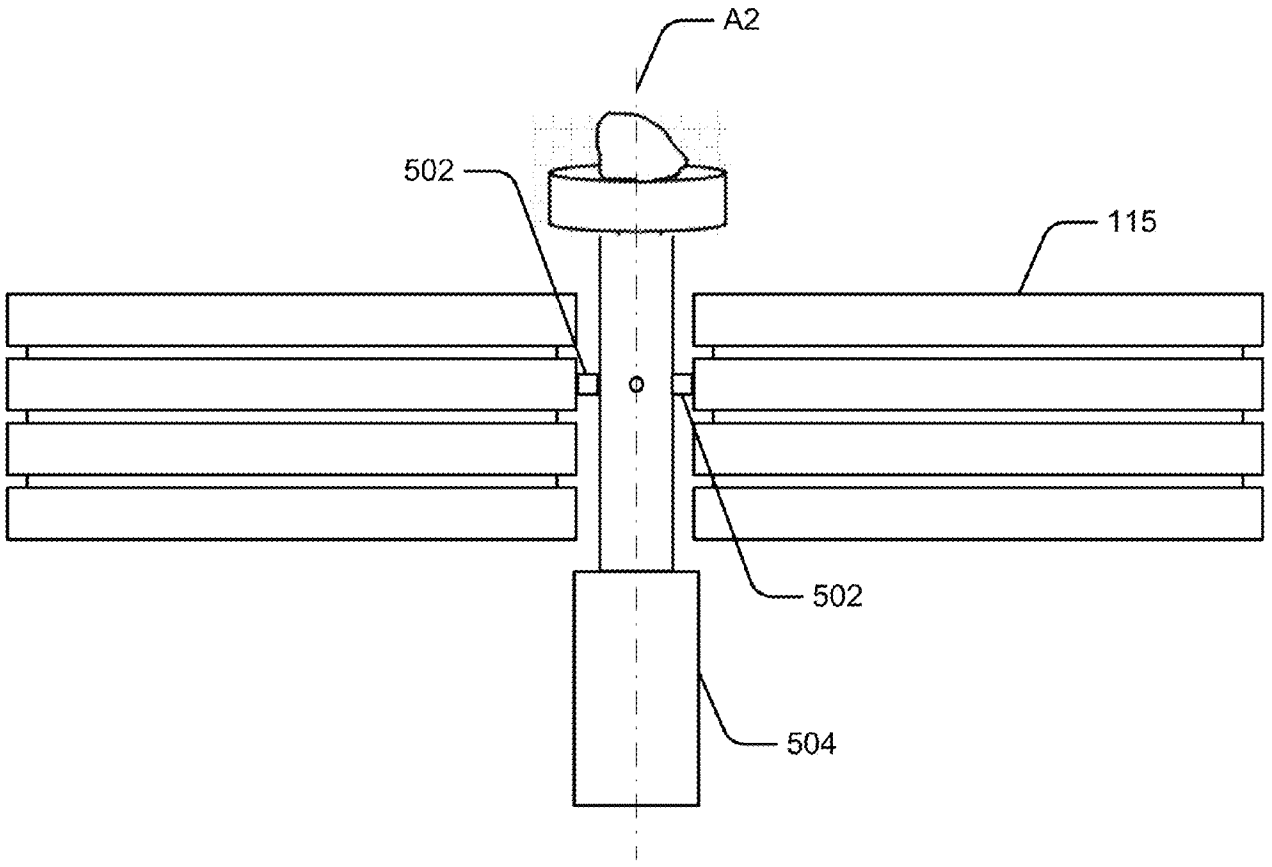
FIG. 5*b* illustrates a side view of the base plate depicting a translational mechanism of the holder in accordance with one implementation of the present subject matter.

FIG. 5*b* illustrates a side view of the translational mechanism of the holder 120 in accordance with one implementation of the present subject matter. As mentioned previously, the holder 120 may be configured to execute the translational motion. In the illustrated implementation, the actuating mechanism 202 includes a holder actuator 504 that may translate the holder 120 along a holder axis A2. Further, the holder 120 may be coupled to the holder actuator 504. In one example, the holder actuator 504 can be, but not limited to pneumatic piston, hydraulic piston, electro magnetic actuator, or the like. In operation, the holder actuator 504 may translate the holder 120 in a manner similar to the translation of the base plate 115 by the linear actuator 306.

Figure 5C:
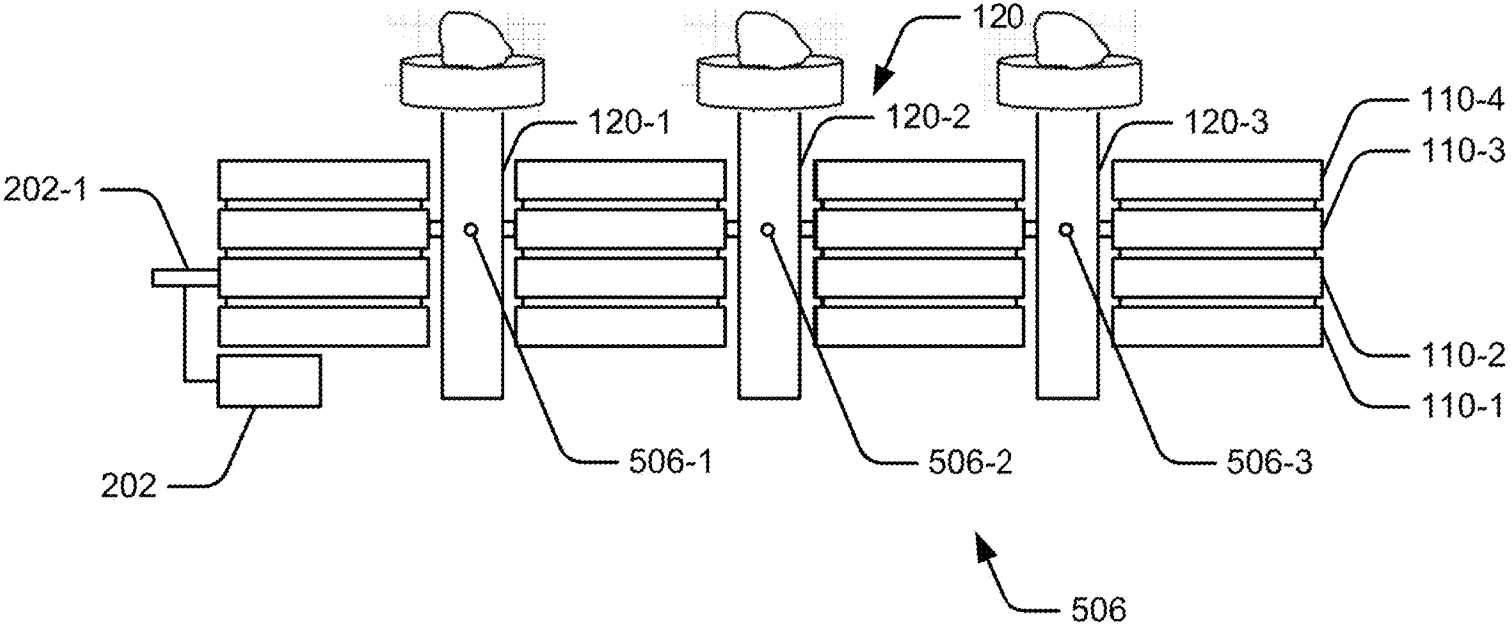
FIG. 5*c* illustrates a side view of the base plate depicting a tilting mechanism of the holder in accordance with one implementation of the present subject matter.

FIG. 5*c* illustrates a side view of a tilting mechanism of the holder 120 in accordance with one implementation of the present subject matter. The holder 120 may be configured to be tilt about the holder A2. Further, the holders 120 may tilt together in a same inclination. As mentioned previously, the bore of the holes 200 (shown in FIG. 2) may be larger than the diameter of the holders 120. Therefore, the clearance between the holes 200 and the holders 120 allow the holders 120 to tilt with respect to the holder axis A2. In the illustrated implementation, the holders 120-1, 120-2, and 120-3 are pivot on the third plate 110-3 pivot points 506-1, 506-2, 506-3; (collectively referred to 506 hereinafter) such that the holder 120-1, 120-2, and 120-3 may pivot. In one implementation, the second plate 110-2 may be configured to slide perpendicular to the holder axis A2 while other plates remain substantially stationary with respect to the second plate 110-2. Further, the sliding motion may be supported by the first plate 110-1. Further, the first plate 110-1 may be actuated by the actuating mechanism 202 through a slider 202-1.

In operation, the holders 120 may be tilted by sliding the second plate 110-2 over the first plate 110-1. For example, the second plate 110-2 may be made to slide from left side to the right side by the slider 202-1. As the second plate 110-2 slides, the second plate 110-2 comes in contact with the holders 120. As the second plate 110-2 further slides, the holders 120 are pushed towards right side. Now, since the holders are hinged at the pivots points 506, the holders 120 the side that holds the pivot gemstone may tilt in left direction. Therefore, tilting motion is achieved. Further, the tilt of the holders 120 are limited by the edges of the holes 200 in the first plate 110-1 and the fourth plate 110-4. The second plate 110-2 may also be moved from right to left in order to tilt the holders 120 towards the right of the holder axis A2. As evident, apart from sideways motion, the second plate 110-2 may be configured to slide in any direction perpendicular to the holder axis A2 thereby impart two dimensional tilting motion to the holders 120.

In one implementation, the holder 120 may be formed as a two part component having an upper portion and a lower portion. Further, the lower portion may be coupled to the actuating mechanism 200 and the upper portion may house the clamp 127 (shown in FIG. 1). In the illustrated implementation, the pivot point 506 may include an assembly of ball joint installed inside the bearings 502. Further, the ball portion of the ball joint assembly may include two projections that may project vertically opposite along the holder axis A2. Further, the two projections may receive the lower portion of the holder 200 and the upper portion of the holder 200. In the illustrated implementation, the bearings 502 may be installed inside a sleeve that may slide inside the hole. Further, the sleeve may include male splines on a outer radial surface and the hole 200 may include female spline on an internal radial surface of the hole 200 such the male spline of the sleeve may mesh with the female spline of the hole 200. Such an arrangement would help the holder 200 to execute the aforementioned motion. For example, the bearings 502 may facilitate in imparting rotational motion to the holder 200. In addition, the splines of the sleeve and the hole 200 may facilitate the translational motion to the holder 200. Moreover, the ball joint assembly may facilitate the tilting motion of the holder 200.

In yet another implementation, the pivot point 506 may include a semi-circular gear assembly. As mentioned previously, the holder 200 may be formed as a two part component with the upper portion and the lower portion. Further, the semi-circular gear assembly may include a gear that may be mounted on a tip of the lower portion of the holder 200. In addition, the semi-circular assembly may include a semi-circular gear that may be mounted on the bottom of the upper portion of the holder 200 such that the teeth of the semi-circular gear are in a mesh with the teeth of the gear of the lower portion of the holder 200. Further, the gear mounted on the tip of the lower portion may receive a drive from the actuating mechanism 200 by any means known in the art. In operation, in order to tilt the upper portion of the holder 200, the gear on the tip of the lower portion of the holder 120. As the gear rotates, the semi-circular gear, which is in mesh with the gear on the tip, also rotates thereby tilting the upper portion of the holder 120.

In yet another implementation, the pivot points 506 may include an arrangement similar to the tilting mechanism 300-2. In such case, the holder 120 may be tiled in various directions with respect to the holder axis A2.

Figure 5D:
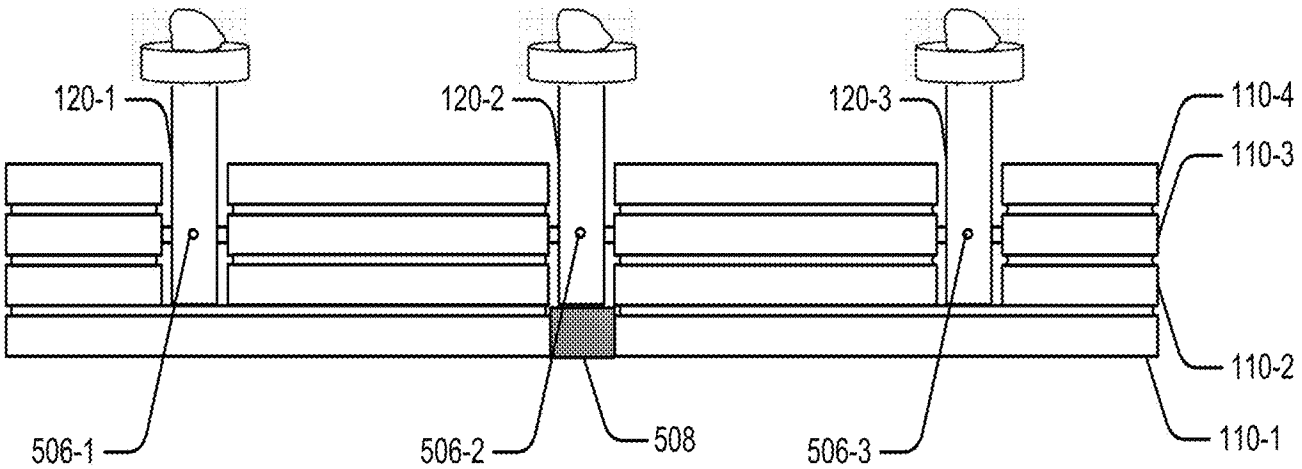
FIG. 5*d* illustrates a side view of the base plate depicting another tilting mechanism of the holders in accordance with one implementation of the present subject matter.

FIG. 5*d* illustrates a side view of the base plate 115 depicting another tilting mechanism of the holders 120 in accordance with one implementation of the present subject matter. In the illustrated implementation, the first plate 110-1 of the base plate 110-1 may be kept stationary and the second plate 110-2, the third plate 110-3, and the fourth plate 110-4 may rotate about the longitudinal axis A1 (shown in FIG. 3*b*). As mentioned previously with respect to FIG. 4, the holders 120 may be hinged at their respective pivot points 506. Further, the first plate 110-1 may include a tilting actuator 508 that may tilt individual holder 120. Further, the tilting actuator 508 may be actuated by the actuating mechanism 202. The tilting actuator 508, in operation, may displace the lower portion of the holder 120 to tilt the holder with respect to the holder axis A2 (shown in FIG. 5*a*). Further, the tilting actuator 508 may tilt the holder 120 at any acute angle with respect to the holder axis A1.

In operation, the holder 120 that needs to be tilted is brought to come in contact with the tilting actuator 508. Initially, the second holder 120-2 is in contact with the tilting actuator 508. Now, in order to tilt the second holder 120-2, the tilting actuator 508 may be actuated by the actuating mechanism 202. As a result, the tilting mechanism 202 may displace the second holder 120-2. Since, the second holder 120-2 is hinged at the second pivot point 506-2, the second holder 120-2 may pivot the second pivot 506. This further results the tilting of the top portion that holds the gemstone 105 (shown in FIG. 1) with respect to the holder axis A2. Now, in order to bring the second holder in the upright position, the tilting actuator 508 may displace the lower end of the second holder 120-2 in a direction opposite to the direction of previous displacement.

Further, in order to tilt the first holder 120-1, the first plate 110-1, the second plate 110-2, and the third plate 110-3 may be rotated with respect to the first plate 110-1. In one example, theses plates are rotated in clockwise direction. As these plates rotate, the first holder 120-1 gets positioned above the tilting actuator 508. Thereafter, the first holder may be tilted by the similar operation as explained earlier. Therefore, individual holders 120 may be tilted. In another implementation, individual tilting actuators 508 may be coupled to holders 120-1, 120-2, and 120-3. In such implementation, the second plate 110-2, the third plate 110-3, and the fourth plate 110-4 may be kept substantially stationary with respect to the first plate 110-1.

In another implementation, the tilting actuator 508 may in a form of a circular disc with a projection positioned eccentric with respect to an axis of rotation of the circular disc. In one example, the projection may in the form of a circular ball. Further, the circular disc may rotate the about holder axis A2. In the illustrated implementation, the holders 120 may have a cavity to receive the projection of the circular disc and the plates 110 may remain substantially stationary. Further, the tilting actuator 508 installed on a positioning platform (not shown in FIG.) such that the positioning platform may position the tilting actuator 508 below the holes 200. In addition, the platform may raise and lower the tilting actuator 508 to come in contact with the lower portion of the holder 120 to tilt the holder 120. In operation, the positioning platform may position the tilting actuator 508 below the hole 200. Thereafter, the positioning platform may raise the tilting actuator 508 to insert the projection in the cavity in the lower portion of the holder 120. Thereafter, the tilting actuator 508 may be rotated up to a certain degree in clock wise direction. As the circular disc rotates, the projection pushes the lower portion of the holder 120 to rotate along with the rotation of the circular disc. Since, the holder 120 is pivoted at the pivot point 506, the holder 120 may tilt about the pivot point 506 and hence, tilting motion is provided to individual holder 120.

In yet another implementation, the tilting actuator 508 installed on the positioning platform and may be kept substantially stationary with respect to the base plate 115. Further, the platform may position the tilting actuator 508 such that when the base plate 115 is rotated to index the gemstone, the holes 200 may get aligned above the tilting actuator 508. Further, the platform may raise, lower and actuate the tilting actuator 508 in a manner described in the previous embodiment. In operation, the base plate 115 may be rotated in such that the hole 200 may get align above the platform. Thereafter, the positioning platform may raise the tilting actuator 508 to insert the projection in the cavity of the holder 120. Thereafter, the tilting actuator 508 may rotate to tilt the holder 120. After the tilting of the holder 120 is achieved, the tilting actuator 508 may rotate in opposite direction to bring the holder 120 in upright position. Thereafter, the positioning platform may lower the tilting actuator 508 to disengage the tilting actuator 508 from with the holder 120. Thereafter, the indexing mechanism 130 (shown in FIG. 3*a*) may index the base plate so that the next hole 200 is aligned above the platform. Therefore, single tilting actuator may be used to selectively tilt the holders 120.

The indexing unit 100 of the present subject matter facilitates the processing of various gemstones 105 with a reduction in the down time required for mounting and demounting the gemstones 105. Further, the employment of multiple holders 120 increases the productivity of the gemstone processing machine. In an example, the indexing unit 100 of the present subject matter can be employed in a computer assisted gemstone processing machines, such as a computer numeric controlled (CNC) machine. In such a case, each holder 120 can be identified by a packet number. The details concerning the packet numbers of various holders 120, for identifying the holder 120 and the associated processing of the gemstone mounted on that holder 120, can be introduced within a central server (not shown in the figure) in the form of barcodes. In an example, the central server can be coupled to the computer control module of the indexing unit 100 or the gemstone processing machine.

Further, according to an aspect of the present subject matter, a method for processing the gemstones 105 on the gemstone processing machine is described. According to the method, the gemstone 105 is mounted in one of the holders 120 disposed in the axially extending hole 200 in the base plate 115. For processing the gemstone 105, the base plate 115 is actuated by the indexing mechanism 130 and the holder 120 is actuated by the actuating mechanism 202. Further, the gemstone 105 mounted on the holder 120 is processed using the various processing steps, for example, sawing or cleaving, bruiting, polishing, and final inspection, by actuating the base plate 115 and the holder 120. However, it will also be understood that during processing one of the base plate 115 and the holder 120 can be kept stationary, while actuating the other.

According to an aspect, while one gemstone 105 is being processed another gemstone 105 is mounted in a subsequent holder 120. Once the processing of the first gemstone 105 is completed, the base plate 115 is indexed, with the help of the indexing mechanism 130, to position the other holder 120 for processing the subsequent gemstone 105. As will be understood, as the base plate 115 is indexed, the processed gemstone is positioned away from the processing unit of the gemstone processing machine, and can be dismounted. Subsequently, the other gemstones are processed on the gemstone processing machine in the same manner as described.

Although the subject matter has been described in considerable detail with reference to certain embodiments thereof, other embodiments are also possible. As such, the appended claims should not be limited to the description of the embodiment described herein.

I claim:

1. An indexing unit of a gemstone processing machine, the indexing unit comprising:

a base plate comprising a plurality of plates, each of the plurality of plates having a plurality of axially extending holes wherein the holes in one plate are substantially coaxial with the holes in the other plates;

an indexing mechanism operably coupled to the base plate, wherein the indexing mechanism is to impart at least one of a rotational motion, a tilting motion, and a translational motion to the base plate;

a plurality of holders, each of the plurality of holders being configured to hold a gemstone for processing on the gemstone processing machine, wherein one holder is disposed in one of the plurality of axially extending holes coaxially provided in the base plate, each of the plurality of holders being pivotable in the axially extending hole, actuable along an axial direction in the axially extending hole, and rotatable inside the axially extending hole when positioned in the base plate; and at least one actuating mechanism coupled to the plurality of holders, the at least one actuating mechanisms being capable of providing at least one of a rotational motion, a translational motion, and a tilting motion to at least one of the plurality of holders.

2. The indexing unit as claimed in claim 1, wherein at least one of the plurality of plates is slidable with respect to other plates to tilt the plurality of holders.

3. The indexing unit as claimed in claim 1, wherein the each of the plurality of holders is coupled to individual actuating mechanisms to provide at least one of a rotational motion, a tilting motion, and a translational motion to the each of the plurality of holders.

4. The indexing unit as claimed in claim 1, wherein the indexing mechanism comprises an actuator and a transmission system, the actuator being operably coupled to the transmission system and the transmission system being operably coupled to the base plate, wherein the actuator is to impart at least one of the rotational motion, the translational motion, and the tilting motion to the base plate.

5. The indexing unit as claimed in claim 1, wherein the plurality of holders are coupled to the actuating mechanism through an operating member, the operating member being one of a gear box, a chain drive, a belt drive, and a pinch roller system.

6. The indexing unit as claimed in claim 1, wherein the indexing mechanism is to impart rotational motion to the base plate using one of belt drive, a chain driver, a gear train, a pinch roller system, a continuously variable transmission, and a fluid coupling.

7. The indexing unit as claimed in claim 1, wherein the indexing mechanism is to impart translational motion to the base plate using a spline shaft, pneumatic piston, hydraulic piston, and solenoid.

8. The indexing unit as claimed in claim 1, wherein the indexing mechanism is to impart tilting motion to the base plate using one of a ball joint, a single knuckle joint, a double knuckle joint, a double cardan joint, a universal coupling, a constant velocity joint, and a Thomson coupling.

9. The indexing unit as claimed in claim 1, wherein the actuating mechanism is one of a stepper motor, a direct current motor, and an alternating current motor.

10. A method for processing gemstones on a gemstone processing machine, the method comprising:

mounting a gemstone in one of a plurality of holders disposed in a base plate, the base plate comprising a plurality of plates, each of the plurality of plates having a plurality of axially extending holes wherein the holes in one plate are substantially coaxial with the holes in the other plates; and wherein, an indexing mechanism operably coupled to the base plate, wherein the indexing mechanism is to impart one of a rotational motion, a tilting motion, and a translational motion to the base plate, and wherein each of the plurality of holders are coupled to at least one actuating mechanism coupled to the plurality of holders, the at least one actuating mechanism being capable of providing at least one of a rotational motion, a translational motion, and a tilting motion to each of the plurality of holders;

processing the gemstone mounted on the one of the plurality of holders, the processing being achieved by actuating at least one of the base plate and the one of the plurality of holders, wherein another gemstone is mounted in another holder from among the plurality of holders during the processing;

indexing the base plate to position the other holder for processing the other gemstone, wherein the processed gemstone is dismounted from the holder during the indexing; and processing the other gemstone.

* * * * *